US005734321A

United States Patent [19]

Takahashi

[11] Patent Number: 5,734,321

[45] Date of Patent: Mar. 31, 1998

[54] FIRE PROTECTION RECEIVER AND FIRE PROTECTION RECEIVER SYSTEM

[75] Inventor: Keiichi Takahashi, Tokyo, Japan

[73] Assignee: Nohmi Bosai Ltd., Tokyo, Japan

[21] Appl. No.: 763,345

[22] Filed: Dec. 11, 1996

Related U.S. Application Data

[63] Continuation of Ser. No. 318,843, filed as PCT/JP94/00360 Mar. 7, 1994, abandoned.

[30] Foreign Application Priority Data

Mar. 8, 1993 [JP] Japan ..... 5-073038
Mar. 9, 1993 [JP] Japan ..... 5-075424

[51] Int. Cl.[6] ..... G08B 26/00

[52] U.S. Cl. ..... 340/505; 340/514; 340/517; 340/518; 364/557

[58] Field of Search ..... 340/505, 506, 340/514, 517, 518, 588, 589, 825.5; 364/551.01, 557

[56] References Cited

U.S. PATENT DOCUMENTS

| | | | |
|---|---|---|---|
| 4,465,904 | 8/1984 | Gottsegen et al. | 340/518 |
| 4,581,606 | 4/1986 | Mallory | 340/506 |
| 4,951,029 | 8/1990 | Severson | 340/506 |
| 5,408,217 | 4/1995 | Sanderford, Jr. | 340/518 |

FOREIGN PATENT DOCUMENTS

| | | |
|---|---|---|
| 63-237196 | 3/1988 | Japan . |
| 2-213999 | 8/1990 | Japan . |
| 3-55693 | 3/1991 | Japan . |

*Primary Examiner*—Donnie L. Crosland
*Attorney, Agent, or Firm*—Wenderoth, Lind & Ponack

[57] ABSTRACT

When updating the data of an EEPROM, wherein set data such as interlock data showing the interlock relationship between fire detectors and controlled equipment, data on correspondence between terminal addresses and places where the terminals are installed, display data to be shown on a display unit of the fire protection receiver, and receiver function data showing the functions of the fire protection receiver is stored, a fire protection receiver according to the present invention employs a memory pack comprised of an IC card or the like, which is disconnectably attached to the fire protection receiver, connects a memory pack, which stores data for updating set data, into the receiver, reads it, and writes it to the EEPROM. Alternatively, set data before updating stored in the EEPROM may be read into the memory pack, which is carried to a service center or the like, where set data for updating is created, referring to the set data before updating, and the created set data for updating may be written into the EEPROM via the memory pack in a similar manner. This makes it possible to provide a fire protection receiver and a fire protection receiver system, which enable a person, who does not know about a ROM, i.e., an electronic circuit, to update set data securely and which permits easy updating.

14 Claims, 8 Drawing Sheets

FIRE PROTECTION RECEIVER AND FIRE PROTECTION RECEIVER SYSTEM

This application is a continuation of now abandoned application, Ser. No. 08/318,843, filed as PCT/JP94/00360, Mar. 7, 1994, now abandoned.

TECHNICAL FIELD

The present invention relates to a fire protection receiver and a fire protection receiver system including the fire protection receiver, which provide the functions of a central processing unit mainly controlling terminals and displaying information, status, etc., in fire protection equipment primarily composed of a fire detector, a controlled apparatus composed of, for example, a smoke controller, the actuation thereof being interlocked with the fire detector, and a transmitter connected to the foregoing component units.

BACKGROUND ART

FIG. 8 is a conceptual view showing an example of a fire protection receiver in conventional fire protection equipment.

The example of the conventional equipment has a display unit 30 showing fire information, operation statuses, etc., a control unit 40 composed of switches and the like, and a printer 50 on the front surface of a receiver R. Provided inside the receiver R are mainly a CPU (not shown), which controls the receiver R, and a ROM (read-only memory) 70 wherein preset data is stored.

When installing fire protection equipment at a site such as in a building, data showing the correspondence between the addresses of terminals, including fire detectors and smoke controllers, and the places, where the terminals are installed (e.g., conference rooms, office rooms, and an entrance hall), is stored beforehand in the ROM 70 of the receiver R according to the situations of the site, the data showing such correspondence being used for display at the time of regular inspection or in case a fire alarm is given. Further, interlock data showing the interlock relationship between fire detectors and controlled equipment (data indicating which controlled equipment should be actuated when a certain detector is actuated) and display data to be shown on the display unit of the receiver R are also stored in advance in the ROM 70 when fire protection equipment is installed at a site.

If, however, a partition change or the like takes place after installing the fire protection equipment at a building or the like, and if, for example, an office room is changed to a guest room, then the correspondence between the fire detectors and the installation places changes. This requires updating the set data, which has been stored in the ROM 70.

To update the set data stored in the ROM 70, the ROM 70, which is an IC package having an IC chip sealed with resin, for example, is removed from a ROM socket, which is soldered to a substrate, and then a new ROM 70*a* (a ROM storing updated set data) is inserted into the socket. This completes the updating of the set data.

A person qualified to replace the ROM with the new ROM 70*a*, however, is limited to one who is familiar with the ROM to a certain extent. Moreover, even for a person, who has certain knowledge about the ROM, replacing the ROM requires troublesome work partly due to the need of extreme care to avoid bending the pins of the ROM 70*a*. Further, careless handling of the ROM 70*a* may destroy the stored data because of static electricity or external forces such as shocks may damage the pins of the ROM 70*a* during transportation.

An object of the present invention is to provide a fire protection receiver and a fire protection receiver system for fire protection equipment, which enable a person, who is not familiar with the ROM, i.e., an electronic circuit, to update set data such as interlock data securely and which permits easy updating.

DISCLOSURE OF THE INVENTION

A fire protection receiver in accordance with the present invention is provided with an EEPROM (electrically erasable programable read-only memory) used as an erasable, nonvolatile memory, which stores at least one type of set data among such data as the interlock data showing the interlock relationship between fire detectors and controlled equipment, the data on correspondence between terminal addresses and the places where the terminals are installed, and the display data to be shown on the display unit of the fire protection receiver, and the receiver function data showing the functions of the fire protection receiver; a reading means, which reads the set data for updating from a memory pack comprised of an IC card or the like, wherein the data for updating is stored when the power of the fire protection receiver is turned ON or a similar operation is performed; and a first writing means, which writes the read set data for updating to the EEPROM.

According to the present invention, when the power of the fire protection receiver is turned ON or a similar operation is performed, the set data for updating is read from the memory pack or the like, where the set data for updating for the interlock data, correspondence data, display data, receiver function data, etc. are stored, and the read data is written to the EEPROM; therefore, a person, who does not know about the ROM shaped like an IC package, is able to update the set data such as the interlock data securely and easily. Memory packs or the like composed of IC cards or the like have no pins sticking out and some of them have protective circuits, eliminating the danger of the stored data being damaged.

A fire protection receiver according to another aspect of the present invention is further provided with a second writing means, which transfers the set data currently stored in the EEPROM, which is an erasable nonvolatile memory, to the memory pack and writes it to the memory pack as a preparatory step for updating the set data, so that the set data currently recorded in the EEPROM is transferred to and stored in the memory pack, and the memory pack is carried into a service center or the like, where set data for updating is prepared after discussing the current set data. This allows the set data to be edited at the service center, referring to the old set data recorded in the EEPROM, making it possible to update the set data in accordance with actual circumstances.

The present invention further includes a fire protection receiver system composed of the aforesaid fire protection receiver and the aforesaid memory pack, which is disconnectably connected thereto.

BEST MODE FOR CARRYING OUT THE INVENTION

Figure 1:
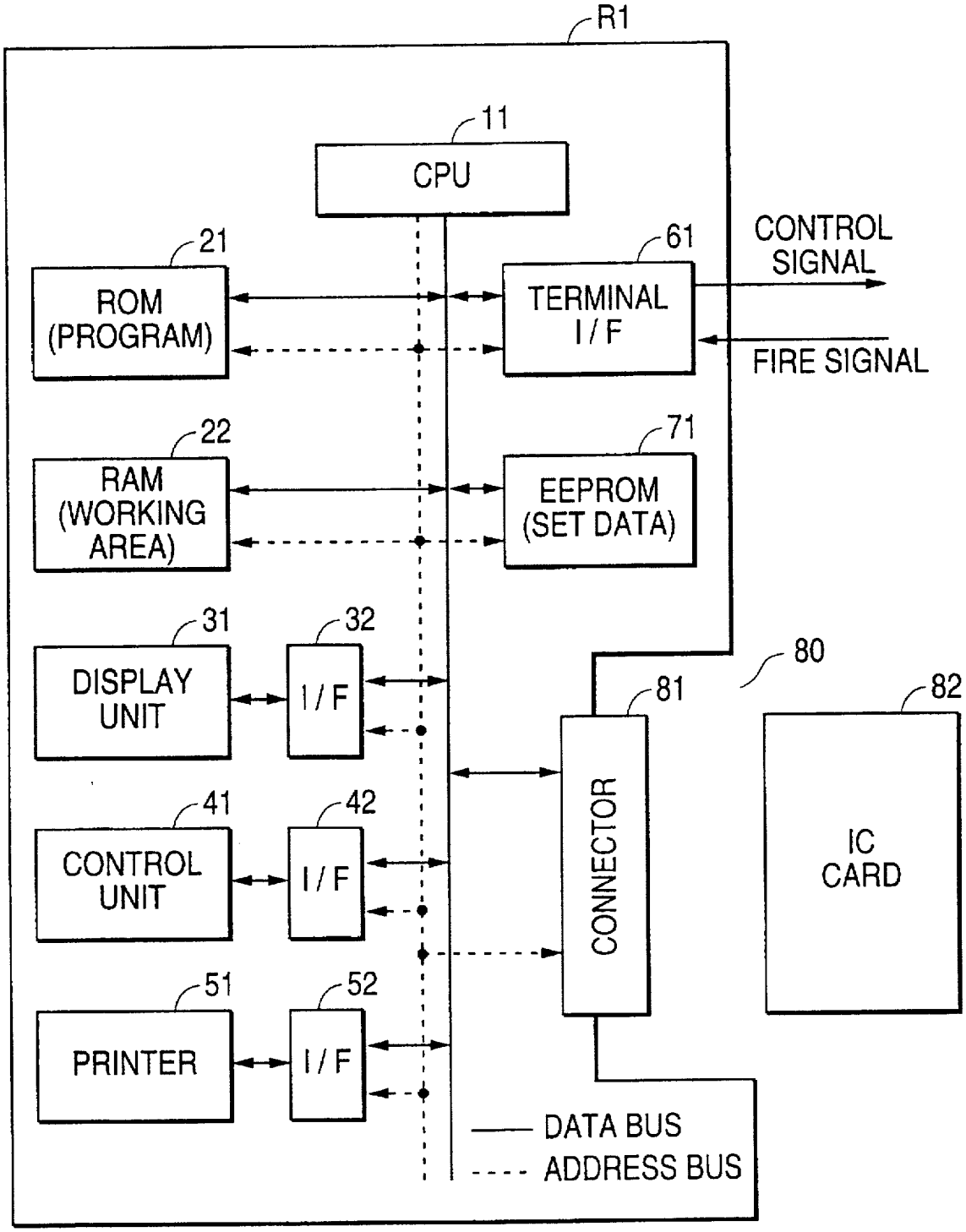
FIG. 1 is a block diagram showing a fire protection receiver system according to a first embodiment of the present invention.

First Embodiment:

FIG. 1 is the block diagram showing an embodiment of the fire protection receiver system according to the present invention.

In this embodiment, a receiver R1 has a CPU (microcomputer) 11, which controls the entire receiver R1 and the terminals (not shown) of controlled equipment, etc. connected thereto, a ROM 21, wherein a program for controlling the receiver R1 and the terminals connected thereto is stored, a RAM (random access memory) 22, which is used as a working area, a display unit 31, which displays a fire district, an automatic test location, etc. and which includes LEDs, liquid crystal display, etc., an interface 32 for the display unit 31, a control unit 41 composed mainly of switches, an interface 42 for the control unit 41, a printer 51, an interface 52 for the printer 51, and an interface 61 for terminals, including fire detectors, transmitters, and smoke controllers. Stored in the ROM 21 is a program related to the flowchart shown in FIG. 2 or FIG. 3.

The receiver R1 further has an EEPROM 71 for storing set data and a connector 81 for disconnectably connecting an IC card 82 to data buses (shown by solid lines) and address buses (shown by dashed lines) in the receiver R1. The IC card 82 is inserted into an inserting port 80, which is provided in a front plate of the receiver R1, the inserting port 80 being normally plugged with a cover (not shown). The inserting port 80, however, may not be provided with a cover.

The EEPROM 71 is a nonvolatile memory, which stores various types of set data such as the interlock data showing the interlock relationship between the fire detectors and controlled equipment, the data on the correspondence between terminal addresses and the locations, where the terminals are installed, display data shown on the display unit 31 of the fire protection receiver R1, and receiver function data showing the functions of the fire protection receiver R1, and it stores at least one type of set data composed of such data as the interlock data, correspondence data, display data, and receiver function data.

The interlock data showing the interlock relationship between the fire detectors and controlled equipment works, for example, in the following manner; when smoke controllers are considered as the controlled equipment, if the first fire detector through the third fire detector detect a fire, then the first smoke controller is interlocked, or if the fourth fire detector through the sixth fire detector detect a fire, then the second smoker controller is interlocked. The display data shown on the display unit 31 of the fire protection receiver R1 includes the data indicating the fact that a fire has broken out and the location where the fire has broken out, which is typically represented by a message "The conference room on the first floor is on fire," and the data showing a menu giving choices of testing, maintenance, interlock cutoff, data list, guide list, etc. The receiver function data showing the functions of the fire protection receiver R1 includes the data indicating the functions such as fire alarm retransmission.

The CPU 11 and the ROM 21 are examples of the reading means for reading data from the IC card 82 when the power of the fire protection receiver is turned ON. The IC card 82 is an example of a nonvolatile memory pack, wherein at least one set datum among the aforesaid interlock data, correspondence data, display data, and receiver function data is stored. The CPU 11 and the ROM 21 are also examples of the first writing means for writing the data, which has been read from the IC card 82, to the EEPROM 71.

The operation of the embodiment described above will now be described.

Figure 2:
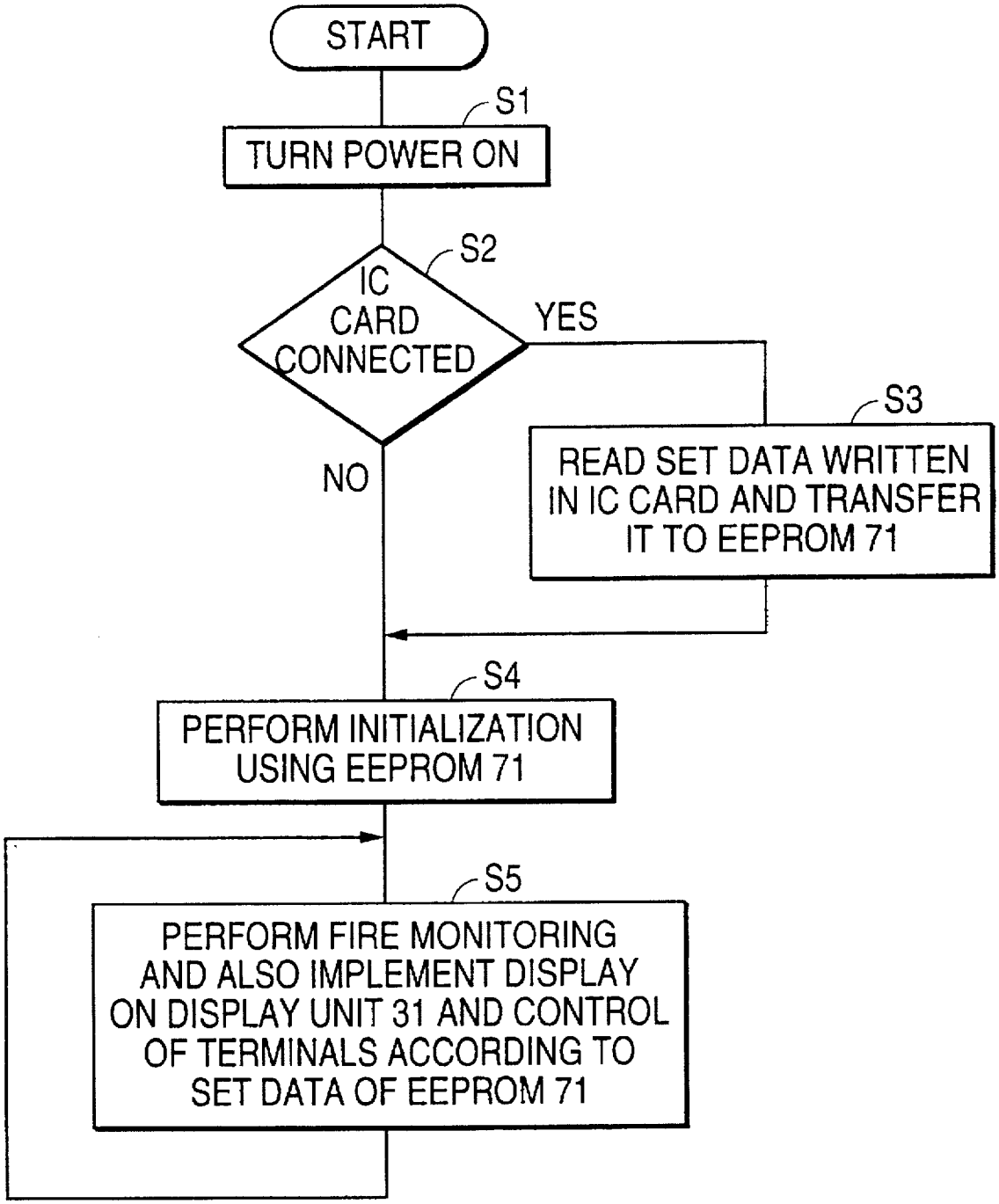
FIG. 2 is a flowchart showing the operation of the first embodiment.

FIG. 2 is the flowchart showing the operation of the above embodiment.

First, the power switch of the receiver R1 is turned ON (step S1). At this time, if the IC card 82 is not connected to the connector 81 (step S2), then initialization is carried out in accordance with the then contents stored in the EEPROM 71 (step S4). Fire monitoring is performed, a display is provided on the display unit 31 according to the set data stored in the EEPROM 71, and terminals are controlled (step S5).

If a change of partition or the like is made at a site, wherein fire protection equipment is installed, then it is necessary to update the set data according to the new partition or the like. For this purpose, the set data for updating is written to the IC card 82 at a service center or a factory or the like. The IC card 82 is sent to the site. The power of the receiver R1 is turned OFF, and the IC card 82 is attached to the connector 81 of the receiver R1, and the power switch is turned back ON to actuate the power.

In this case, since the power switch of the receiver R1 is turned ON (step S1) and the IC card 82 has been connected to the connector 81 (step S2), the set data for updating stored in the IC card 82 is read, and the read set data for updating is transferred to and stored in the EEPROM 71 (step S3). Initialization is performed in accordance with the new contents stored in the EEPROM 71 (step S4), fire monitoring is carried out, a display is provided on the display unit 31 according to the new set data stored in the EEPROM 71, and the terminals are controlled (step S5).

In the above embodiment, updating the set data such as the interlock data, correspondence data, display data, and receiver function data can be accomplished simply by attaching the IC card 82, which stores the set data for updating, to the connector 81 and turning the power ON. Hence, even a person who is not familiar with the ROM 21, can securely update the set data such as the interlock data. Moreover, the set data can be updated more easily since there is no need to use care not to break the pins of the ROM as it used to be.

Figure 3:
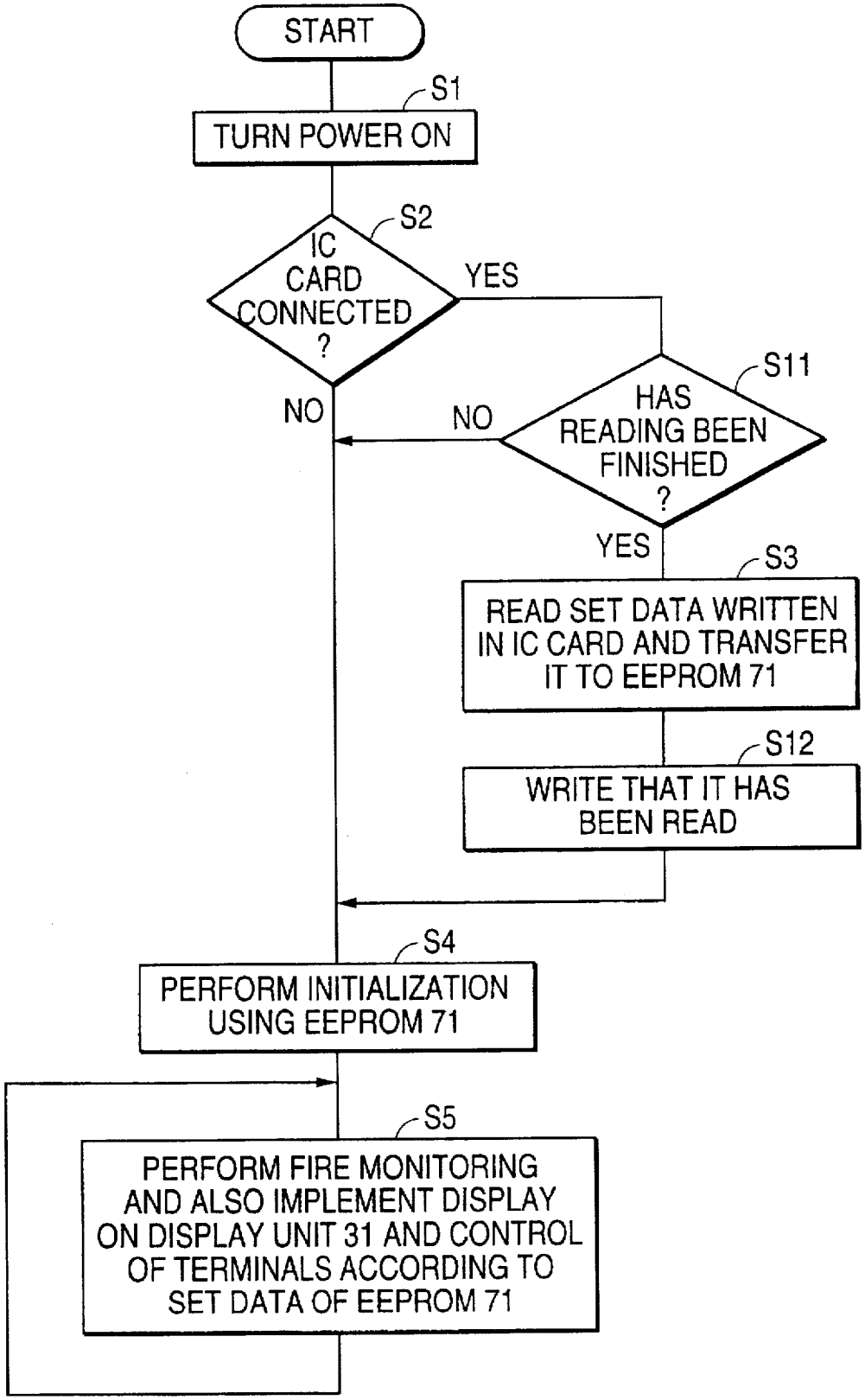
FIG. 3 is a flowchart showing another operation of the first embodiment.

FIG. 3 is the flowchart showing another operation of the above embodiment. The configuration of the fire protection receiver is identical to that shown in FIG. 1.

In this embodiment, a step S11, wherein it is determined whether the IC card has been read after it is determined that the IC card is connected in the step S2 of the flowchart shown in FIG. 2, and a step S12, wherein it is recorded that the read data has been written to the EEPROM 71 after that, are added to the flowchart of FIG. 2.

More specifically, storing the information, which tells that the data of the IC card 82 has been written (read), in the RAM 22 in the receiver R1 (step S12) after the data for updating stored in the IC card 82 is written to the EEPROM 71 (step S3) allows initialization (step S4) to be carried out directly after checking from the RAM 22 that the data has been read (step S11) if the IC card 82, which has been read, is left connected (if the receiver R1 requiring no data change is actuated), thus omitting wasteful double writing. The IC card 82, from which the set data thereof has been read, may be removed from the connector 81 or it may be left connected. After the IC card 82 is removed, the information in the RAM 22, which has been read, may be cleared. Alternatively, the information, which has been read, may be written to the IC card 82 instead of writing the information, which has been read, to the RAM 22 in the receiver R1.

An entering means composed of an entering key, check switches, etc. (not shown) is provided in the control unit 41 beforehand. The status of the reading having been finished is indicated on the display unit 31 or printed by the printer 51, and an operator visually confirms it, then operates the aforesaid check switch, thereby storing the read (written) information in the RAM 22 or the like.

In the case the operation shown in FIG. 3, whether the information has been read is determined from the contents written to the RAM 22 and, according to the determination result, the set data of the IC card 82 is transferred to the EEPROM 71. In the step S11 of FIG. 3, for example, before reading the information, the contents of the IC card 82 are compared with the contents of the EEPROM 71, and if both the contents are the same, then updating is not implemented. This also makes it possible to omit wasteful writing. In this case, the step S12, wherein the state of the reading having been finished is written to the RAM 22 or the like, is unnecessary.

Figure 4:
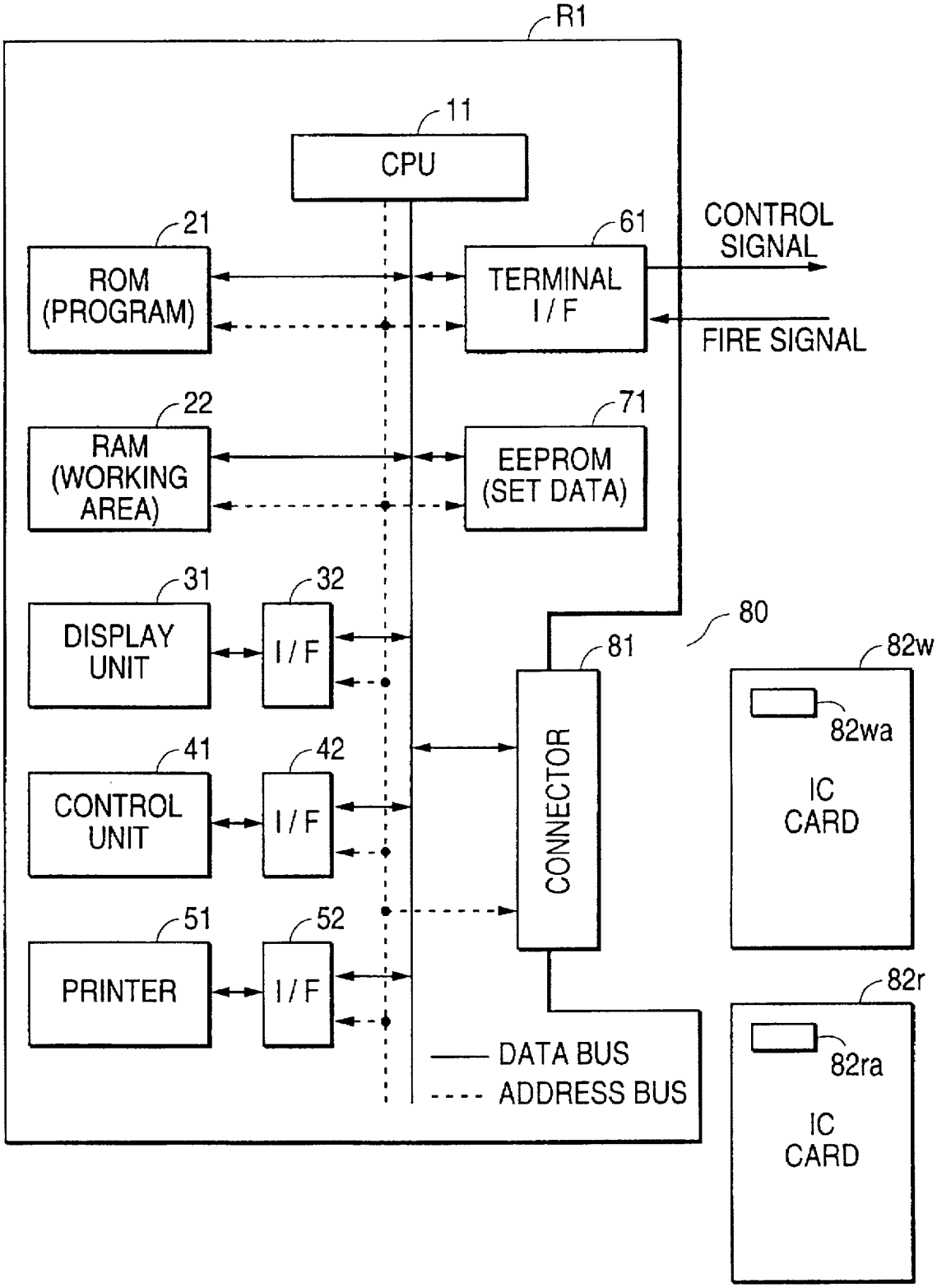
FIG. 4 is a block diagram showing a fire protection receiver system according to a second embodiment of the present invention.

Second Embodiment:

FIG. 4 is the block diagram showing another embodiment of the fire protection receiver system according to the present invention.

In the fire protection receiver R1 of FIG. 4, the current set data stored in the EEPROM is written to the IC card and the set data for updating is created according to that data, then the set data for updating is transferred from the IC card to the EEPROM by writing it thereto. In the case of this embodiment, two cards are used; one is a write-only IC card **82*w* exclusively used for writing the current set data stored in the EEPROM 71 and the other is a read-only IC card 82*r*, which stores set data for updating. Other basic structure or the like of the receiver R1 is almost the same as that shown in FIG. 1**.

The CPU 11 and the ROM 21 are the examples of the reading means for reading data from the read-only IC card **82*r* and the first writing means for writing the data read from the read-only IC card 82*r* to the EEPROM 71 and the second writing means for writing the set data of the EEPROM 71 before updating to the write-only IC card 82*w***.

The operation of the above embodiment will now be explained.

Figure 5:
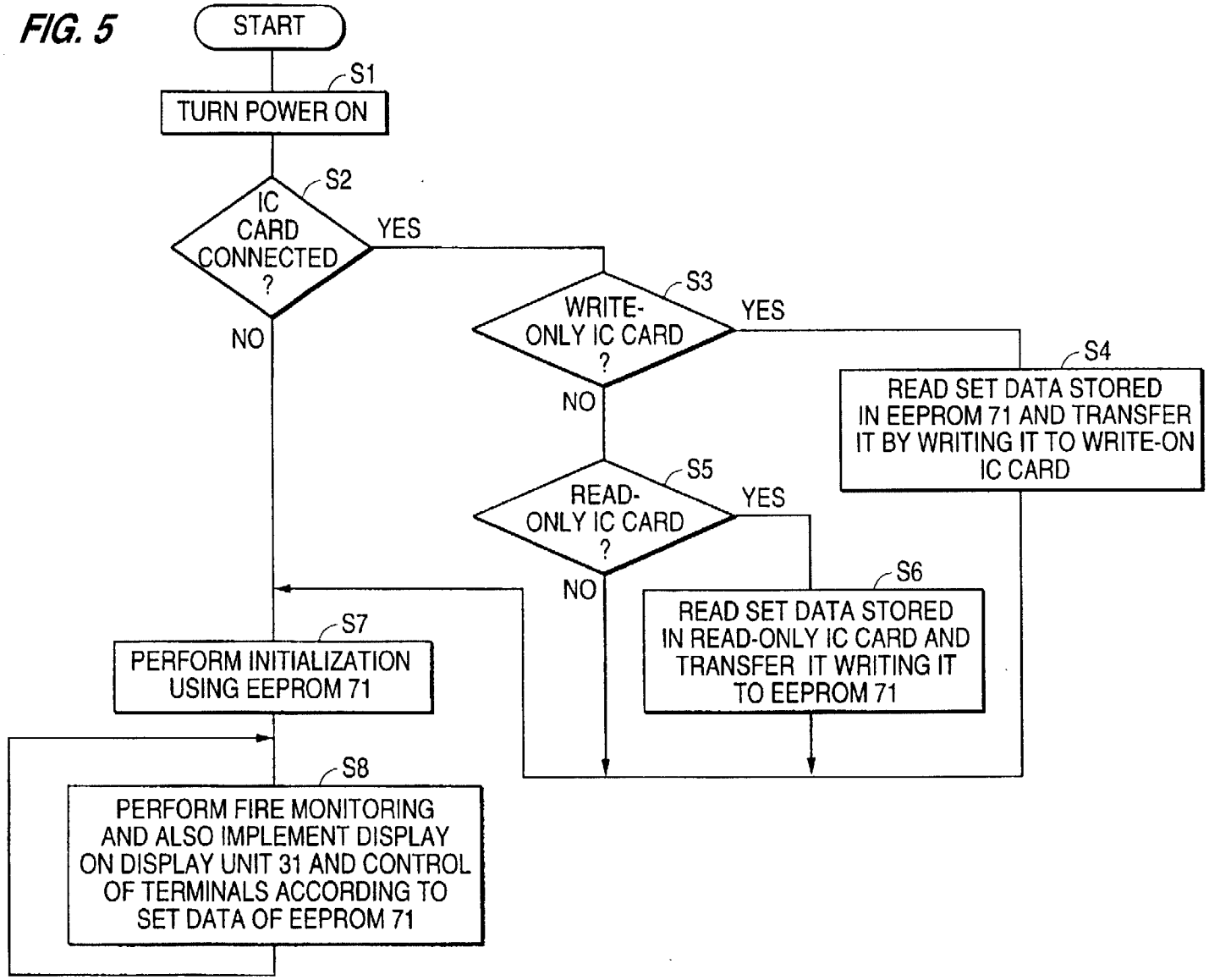
FIG. 5 is a flowchart showing the operation of the second embodiment.

FIG. 5 is the flowchart showing the operation of the embodiment described above.

First, the power switch of the receiver R1 is turned ON (step S1). At this time, if the IC card is not connected to the connector 81 (step S2), then initialization is carried out in accordance with the then contents stored in the EEPROM 71 (step S7). Then fire monitoring is performed, a display is provided on the display unit 31 according to the set data stored in the EEPROM 71, and terminals are controlled (step S8).

If a change of partition or the like is made at a site, wherein fire protection equipment is installed, then it is necessary to update the set data according to the new partition or the like. For this purpose, the write-only IC card **82*w* is connected to the connector 81 of the receiver R1 and the set data currently stored in the EEPROM 71 is written to the IC card, which is then sent to a service center, factory, etc. More specifically, the power of the receiver R1 is turned OFF, the write-only IC card 82*w* is attached to the connector 81 of the receiver R1, and the power switch is turned ON to start the power (step S1). At this time, when the CPU 11 confirms that the IC card is connected (step S2), the CPU 11 reads an attribute area 82*wa* of the IC card 82*w*; when it confirms that the write-only IC card 82*w* is connected (step S3), it reads the set data stored in the EEPROM 71 and the read data is written into the write-only IC card 82*w*** (step S4).

The write-only IC card **82*w* is removed from the connector 81 and sent to a service center, for instance. At the service center, the contents stored in the write-only IC card 82*w* is read and the current set data is displayed on a display (not shown). Referring to the displayed set data and the information on the new partition, new set data is created and the set data for updating is written to the read-only IC card 82*r***, which is sent to the site.

At the site, the power of the receiver R1 is turned OFF, the read-only IC card **82*r* received from the service center is attached to the connector 81, and the power switch is turned back ON to start the power (step S1). If the CPU 11 confirms that the IC card has been connected to the connector 81, the attribute area 82*ra* of the read-only IC card 82*r* has been read, and the read-only IC card 82*r* has been connected (steps S2, S3, and S5), then it reads the set data for updating stored in the read-only IC card 82*r*, and transfers the read set data for updating to and stores in the EEPROM 71 (step S6). Then, initialization is implemented in accordance with the new contents stored in the EEPROM 71 (step S7), fire monitoring is carried out, a display is provided on the display unit 31 according to the new set data stored in the EEPROM 71**, and the terminals are controlled (step S8).

Figure 6:
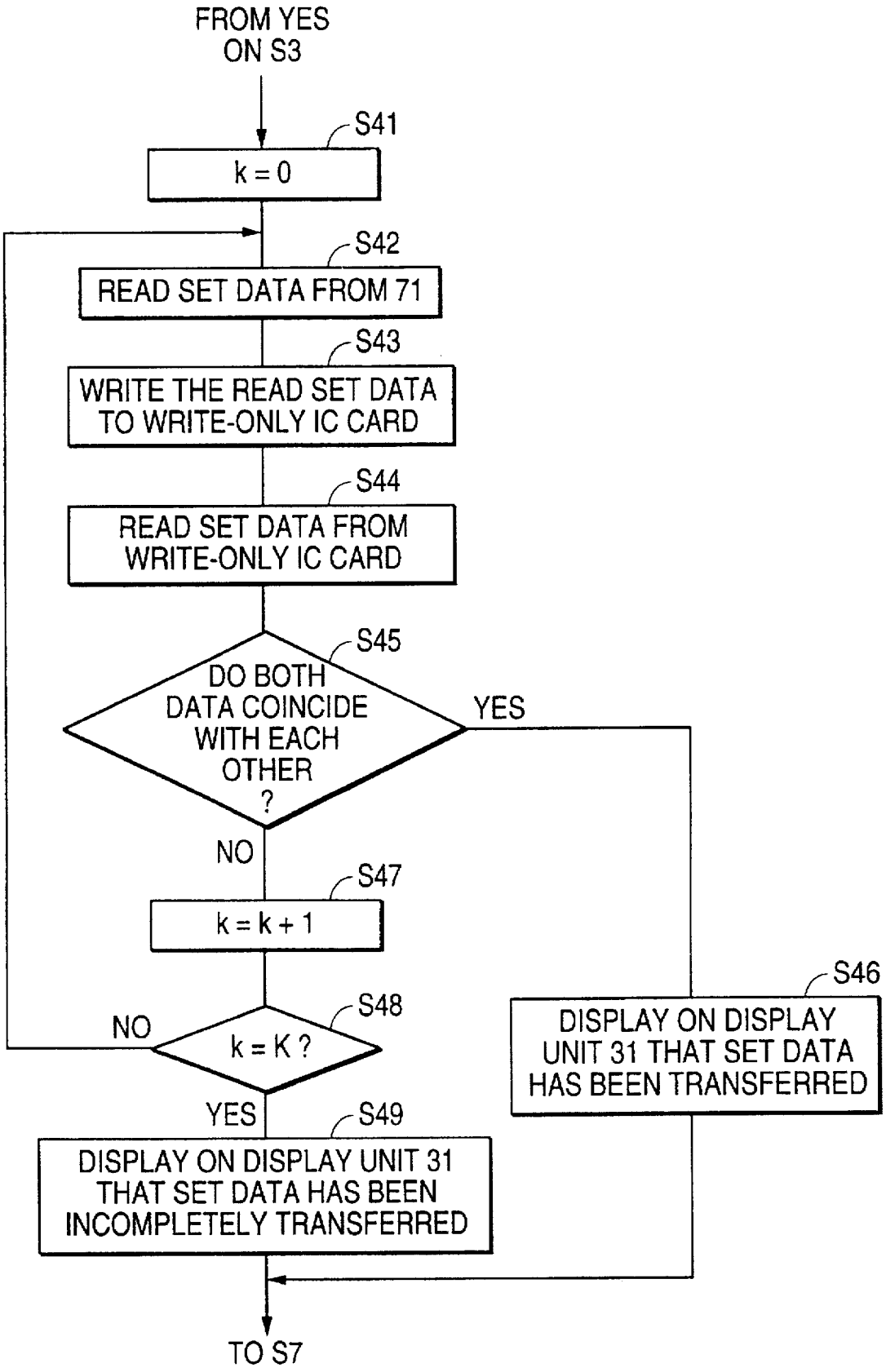
FIG. 6 is a flowchart specifically showing the writing operation given in a step S4 of FIG. 5.

FIG. 6 is the flowchart, which specifically shows the writing operation given in the step S4 of FIG. 5.

When the CPU 11 confirms that the write-only IC card **82*w* is connected to the connector 81 (step S3), it sets a function k of the number of counts to 0 (step S41), reads the set data from the EEPROM 71 (step S42), and writes the read set data into the write-only IC card 82*w* (step S43). In the next step, the CPU 11 reads the set data written into the write-only IC card 82*w* (step S44) and compares it with the set data of the EEPROM 71 (step S45). If they coincide with each other, the CPU 11 decides that the transfer has been completed and it tells that the transfer of the set data has been completed by indicating to that effect on the display unit 31 (step S46), then it goes back to normal processing. If, however, the data of the write-only IC card 82*w* does not coincide with the data of the EEPROM 71, then the CPU repeats the processing from the step S42 through the step S45 for a predetermined number of times K (step S48), and it indicates that the set data has been improperly transferred by displaying to that effect on the display unit 31 (step S49) before it goes back to normal processing. This makes it possible to check that the set data of the EEPROM 71 has securely been transferred to the write-only IC card 82*w***.

Figure 7:
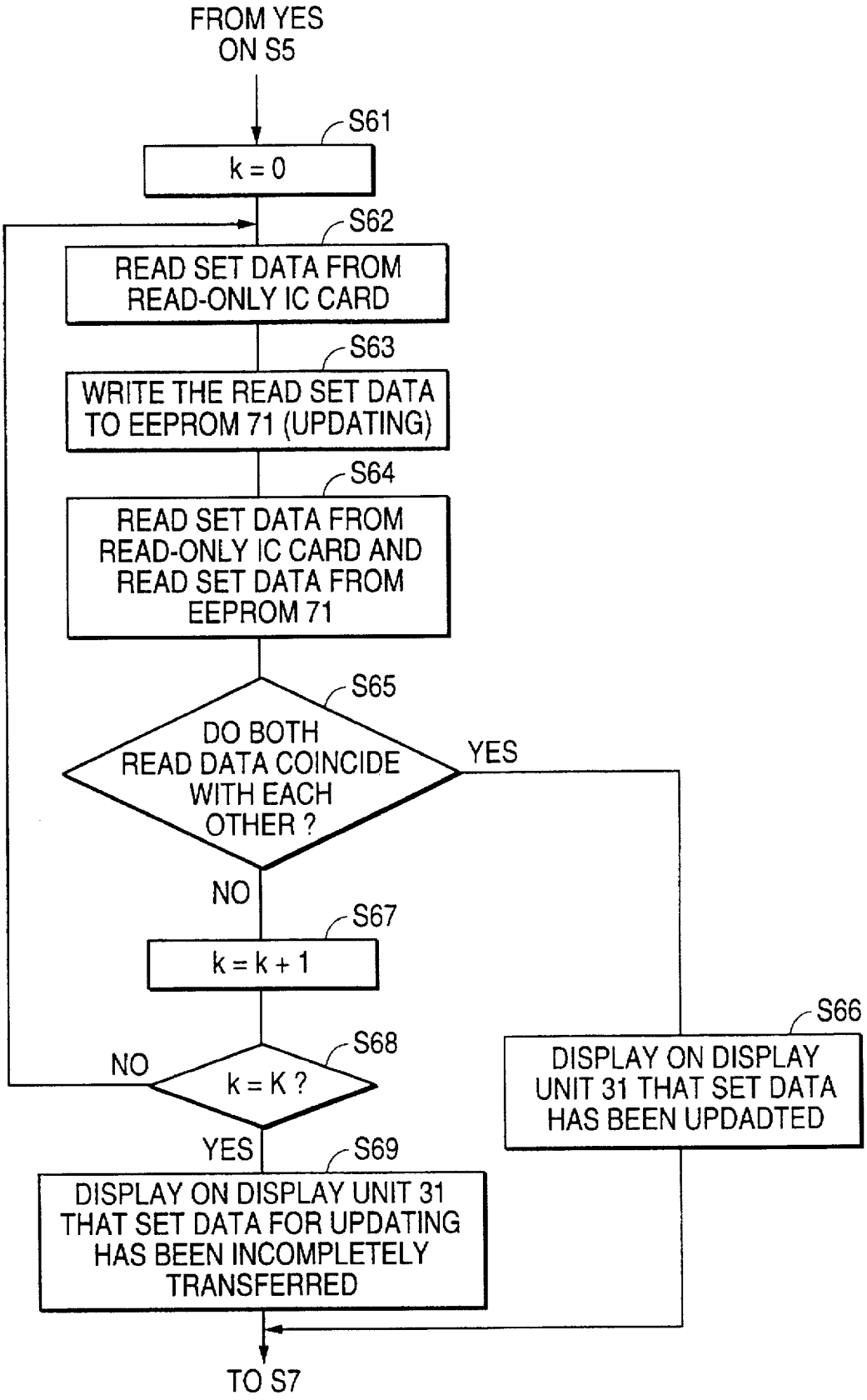
FIG. 7 is a flowchart specifically showing the writing operation shown in a step S6 of FIG. 5.
Figure 8:
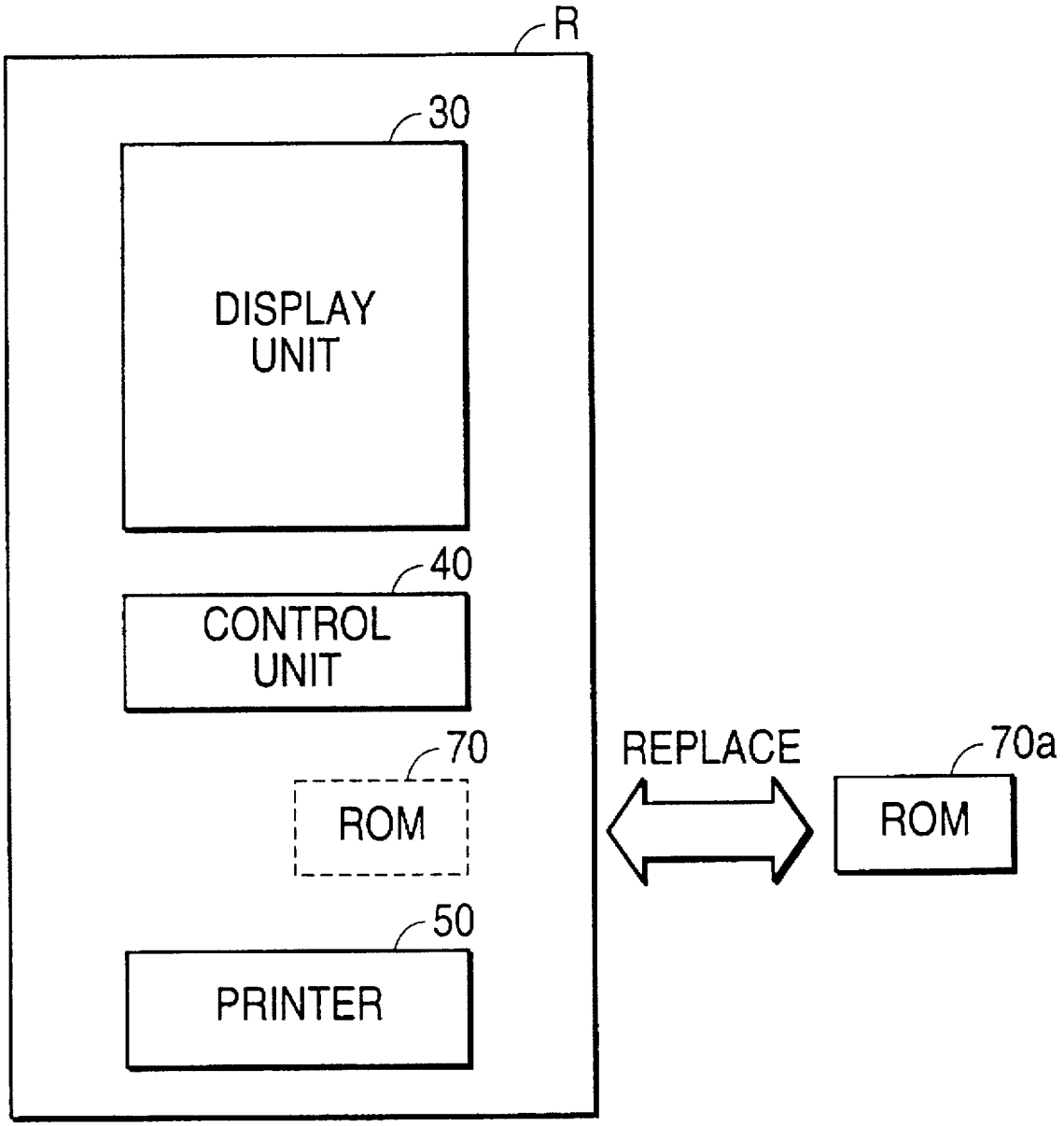
FIG. 8 is a conceptual view showing an example of a fire protection receiver in conventional fire protection equipment.

FIG. 7 is the flowchart, which specifically shows the writing operation shown in the step S6 of FIG. 5.

If the CPU 11 confirms that the read-only IC card **82*r* is connected to the connector 81 (step S5), then it sets the function k of the number of counts to 0 (step S61), reads the set data for updating from the read-only IC card 82*r* (step S62), and writes the read set data into the EEPROM 71 (step S63), thereby updating the set data. In the next step, the CPU 11 reads the updated set data stored in the EEPROM 71 (step S64) and compares the read set data with the set data of the read-only IC card 82*r* (step S65). If they coincide with each other, then the CPU 11 decides that the updating has been completed and it tells that the updating has been completed by indicating to that effect on the display unit 31 (step S66) before it goes back to normal processing. If, however, the data of the EEPROM 71 does not coincide with the data of the read-only IC card 82***r*, then the CPU repeats the processing from the step S62 through the step S65 for a predetermined number of times K (step S68), then it indicates that the set data has been improperly updated by displaying to that effect on the display unit 31 (step S69) before it goes back to normal processing. This makes it possible to check that the set data of the read-only IC card 82*r* has securely been transferred to the EEPROM 71 and updated. If improper updating occurs, then the set data in question may be printed out using the printer 51 instead of displaying it on the display unit 31, thus allowing the cause of the incomplete updating to be identified. When the control unit 41 is provided with a check switch (not illustrated) and if incomplete updating takes place, then the check switch may be pressed to proceed to the step S7 shown in FIG. 5.

In this embodiment, as in the case of the preceding embodiment, the set data can be updated easily by a person, who does not know about the ROM. Moreover, since the set data stored in the EEPROM 71 is written into the write-only IC card 82*w*, the set data before updating can be checked at a service center, allowing the editing to be performed at the service center by referring to the set data before updating. Thus, the set data can be updated in accordance with actual circumstances.

The write-only IC card 82*w* and the read-only IC card 82*r* may be provided with marking on the surfaces thereof or may be designed differently so that they can be visually distinguished.

In the embodiment shown in FIG. 4, the write-only IC card 82*w* and the read-only IC card 82*r* are prepared so that no beginner accidentally confuses them (or no set data for updating, which has been written at the service center is accidentally erased before updating is completed). Alternatively, the write-only IC card 82*w* and the read-only IC card 82*r* may be combined into a single IC card so that writing and reading can be performed using only one card.

Further, in the embodiments described above, the IC cards 82, 82*w* and 82*r* are electrically connected to the connector 81. Alternatively, however, the buses connected to the CPU 11 may be electromagnetically or optically connected to the IC cards via a prescribed interface (not shown). Such electromagnetic or optical connection enables the set data to be transmitted without the IC cards being in contact, permitting even more convenient updating of the set data.

Furthermore, in the embodiments described above, data is written to the IC card and data is read from the IC card when the power of the fire protection receiver R1 is turned ON; alternatively, however, a write starting switch and a read starting switch (not illustrated) may be provided on the control unit 41, for example, of the receiver R1 so that data may be written to the IC card and data may be read from the IC card in accordance with a predetermined actuating operation such as turning the starting switches ON, without the power being involved.

In the above embodiments, the IC cards are used as the examples of memory packs; however, there are other examples of memory packs, including an IC board, wherein the IC is mounted on a substrate but not enclosed in a case, and an optical card. Further, the embodiments discussed above use the EEPROM 71 as the erasable nonvolatile memory; however, a RAM or the like equipped with a backup power supply may be used as the erasable nonvolatile memory in place of the EEPROM 71.

Further alternatively, the status of the set-data stored in the EEPROM 71 having been written to the write-only IC card 82*w* and the status of the set data for updating stored in the read-only IC card 82*r* having been written into the EEPROM 71 may be written into the individual IC cards or in a predetermined memory in the receiver R1 or may be displayed on a display unit in the receiver R1.

The fire protection receiver and the fire protection receiver system according to the present invention are not limited to the embodiments described above, but the scope thereof is based on the scope defined by the attached claims.

Thus, according to the present invention, a person, who is not familiar with the ROM, can update set data such as interlock relationship data securely and moreover, the updating work is easy.

I claim:

1. A fire protection receiver which receives a fire signal from at least one fire detector and issues a control signal to controlled equipment in accordance with set data indicative of a relationship between characteristics of the received fire signal and characteristics of the issued control signal, said fire protection receiver comprising:

a central processing unit;

a first memory, operatively coupled to said central processing unit, having stored therein an operation program executed by said central processing unit;

a second memory, operatively coupled to said central processing unit, for providing a working data area upon execution of the operational program by said central processing unit;

a third memory, operatively coupled to said central processing unit, having stored therein the set data, said third memory being an erasable nonvolatile memory; and, a connector, operatively coupled to said central processing unit, for detachably connecting an external detachable memory pack to said central processing unit, the external detachable memory pack having updated set data stored therein;

wherein, prior to reading the set data stored in said third memory to determine the characteristics of the control signal issued in response to the fire signal, the operation program causes said central processing unit to initially determine whether the external detachable memory pack is connected to said connector, and if the external detachable memory pack is determined to be connected to the connector, to then read the updated set data from the external detachable memory pack and to overwrite the set data already stored in said third memory with the updated set data read from the external detachable memory pack.

2. A fire protection receiver according to claim 1, further comprising a displaying means and a data updating completion writing means for storing a status of the set data for updating of said external detachable memory pack having been written into said erasable nonvolatile memory or in a predetermined memory in the receiver or for displaying it on said displaying means.

3. A fire protection receiver according to claim 1, further comprising a second writing means for writing the set data stored in said erasable nonvolatile memory into the external detachable memory pack.

4. A fire protection receiver according to claim 3, further comprising a displaying means and a data writing completion writing means for storing the status of said set data stored in said erasable nonvolatile memory having been written into said external detachable memory pack or in a predetermined memory in the receiver or for displaying it on said displaying means.

5. A fire protection receiver according to claim 3, further comprising a displaying means and a data updating completion writing means for storing the status of the set data for updating of said external detachable memory pack having been written into said erasable nonvolatile memory or in a predetermined memory in the receiver or for displaying it on said displaying means.

6. A fire protection receiver according to claim 1, wherein the set data stored in said erasable nonvolatile memory includes at least one set data out of interlock data showing the interlocking relationship between said fire detector and controlled equipment, data on correspondence between a terminal address and a place where the terminals is installed, display data to be shown on a display unit of the fire protection receiver, and receiver function data showing the functions of the fire protection receiver.

7. A fire protection receiver which receives a fire signal from at least one fire detector and issues a control signal to controlled equipment in accordance with set data indicative of a relationship between characteristics of the received fire signal and characteristics of the issued control signal, said fire protection receiver comprising:

a central processing unit;

a first memory, operatively coupled to said central processing unit, having stored therein an operation program executed by said central processing unit;

a second memory, operatively coupled to said central processing unit, for providing a working data area upon execution of the operational program by said central processing unit;

a third memory, operatively coupled to said central processing unit, having stored therein the set data, said third memory being an erasable nonvolatile memory;

an external detachable memory pack having updated set data stored therein; and, a connector, operatively coupled to said central processing unit, for detachably connecting said external detachable memory pack to said central processing unit;

wherein, prior to reading the set data stored in said third memory to determine the characteristics of the control signal issued in response to the fire signal, the operation program causes said central processing unit to initially determine whether the external detachable memory pack is connected to said connector, and if the external detachable memory pack is determined to be connected to the connector, to then read the updated set data from the external detachable memory pack and to overwrite the set data already stored in said third memory with the updated set data read from the external detachable memory pack.

8. A fire protection receiver system according to claim 7, wherein said fire protection receiver further comprises a second writing means for writing the set data stored in said erasable nonvolatile memory into said portable external detachable storing means.

9. A fire protection receiver system according to claim 8, wherein said portable external detachable storing means consists of a memory pack, whereto the set data stored in said erasable nonvolatile memory is written and the set data for updating the set data of said nonvolatile memory is written.

10. A fire protection receiver system according to claim 8, wherein said portable external detachable storing means comprises a write-only memory pack for storing said set data stored in said erasable nonvolatile memory and a read-only memory pack, wherein set data for updating the set data of said nonvolatile memory is stored; and said fire protection receiver reads said set data stored in said erasable nonvolatile memory and writes it into said write-only memory pack if said write-only memory pack is connected, while it reads said set data for updating from said read-only memory pack and writes it into said erasable nonvolatile memory if said read-only memory pack is connected.

11. A fire protection receiver system according to claim 10, wherein said write-only memory pack and read-only memory pack include attribute areas indicating that they are the write-only memory pack and the read-only memory pack, respectively.

12. A fire protection receiver system according to claim 11, wherein said write-only memory pack and said read-only memory pack are visually distinguishable.

13. A fire protection receiver system according to claim 7, wherein said memory pack is comprised of an IC card, IC board or an optical card.

14. A fire protection receiver according to claim 7, wherein said external detachable memory pack includes a mating connector.

* * * * *